US006073286A

United States Patent [19]

Wu

[11] Patent Number: 6,073,286

[45] Date of Patent: Jun. 13, 2000

[54] ADJUSTABLE FOLDABLE BED

[75] Inventor: Jack Wu, Taipei, Taiwan

[73] Assignee: Modas Shing Company Ltd., Taipei, Taiwan

[21] Appl. No.: 09/311,114

[22] Filed: May 13, 1999

[51] Int. Cl.[7] ..... A61G 7/015; A61G 7/018

[52] U.S. Cl. ..... 5/618; 5/616

[58] Field of Search ..... 5/618, 616, 617, 5/613, 174

[56] References Cited

U.S. PATENT DOCUMENTS 4,349,924 9/1982 Zur ..... 5/618

4,821,351 4/1989 Bergenwall ..... 5/618

*Primary Examiner*—Alexander Grosz

*Attorney, Agent, or Firm*—William E. Pelton, Esq.

[57] ABSTRACT

An adjustable foldable bed is disclosed. The adjustable foldable bed has a front frame assembly and a rear frame assembly pivotal with respect to the front frame assembly. The foldable bed has a motor securely mounted thereunder, a driving rod driven by the motor, a first connecting rod pivotally connected with the driving rod, a second connecting rod pivotally connected with the first connecting rod. A tube securely provided under the bed is for receiving the second connecting rod therethrough. Furthermore, due to a first connector securely connected with the front frame assembly and pivotally connected with the driving rod, the torso of a hospital patient is supported while a first frame member of the front frame assembly is inclined by the motor. A second connector having an L-shaped channel is pivotally connected under the third frame member of the rear frame assembly and alternatively and slidably receiving the free end of the second connecting rod in the channel, such that the third frame member is alternatively inclined with respect to a second frame member of the front frame assembly.

4 Claims, 8 Drawing Sheets

ADJUSTABLE FOLDABLE BED

BACKGROUND OF THE INVENTION

1. Field of the Invention

The present invention relates to a foldable bed, and more particularly to an adjustable foldable bed. The first frame member can be adjusted to incline separately or simultaneously with the third frame member, such that a hospital patient is able to choose to adjust the position of the torso separately or the torso and the legs simultaneously.

2. Description of Related Art

A lot of patents addressing the function and structure of a hospital bed are available to the public. Functionally, these beds all have one thing in common, that is to provide support to the torso and legs of a patient lying thereon. Normally, a foldable bed used for a patient has a handle, a shaft connected with the handle and linkages connected with the shaft. When the handle is rotated, the shaft with a thread formed thereon will rotate in the same direction as the handle. The rotation of the shaft will thus drive the front portion of the bed or the front and rear portion and cause them to be lifted upward. Because of the movement of the rear portion and the front portion of the bed, the torso or the torso and legs of the patient will be inclined upward. The above mentioned structure can provide substantial support to the torso and legs of the patient. However, the operation of this type of bed requires that a person not in the bed manually turn the handle to adjust the bed. To rectify this shortcoming, a new structure was developed that has at least one motor mounted thereunder, so that the upward movement of the front or the front and rear portion of the bed is driven by a motor that can be operated by the patient in the bed. The conventional mechanized bed increases the efficiency of providing support to the patient, however it is complex in structure and expensive.

The present invention aims to provide an improved a mechanized foldable bed to obviate and/or mitigate the aforementioned problems.

SUMMARY OF THE INVENTION

The main object of the present invention is to provide an adjustable foldable bed. The foldable bed is able to provide support to the torso and/or legs to the patient lying thereon.

In order to meet the above objective, the foldable bed has a front frame assembly composed of a first frame member and a second frame member pivotally connected with the first frame member and a rear frame assembly composed of a third frame member and a fourth frame member pivotally connected with the third frame member. Furthermore, the foldable bed has a motor, a driving rod extendably connected with the motor, a first connecting rod pivotally connected with the driving rod, a second connecting rod pivotally connected with the first connecting rod and a tube securely mounted under the second frame assembly to receive the second connecting rod therethrough. The first frame member has a first connector securely connected thereunder and pivotally connected with the driving rod. The third frame member has a second connector securely connected thereunder and pivotally and slidably connected with the free end of the driven rod. The second connector defines therein an L-shaped slot and the second connecting rod is slidably connected with the second connector in the L-shaped slot.

When the connection between the second connecting rod and the second connector is in the first position, only the first frame member will be inclined with respect to the second frame member when driven by the motor. When the connection between the second connecting rod and the second connector is in the second position, not only the first frame member will be inclined, but also the third frame member will be inclined with respect to the second frame member.

Due to the adjustable movement of the first and third frame members, the torso and legs of the patient lying on the bed will be supported to move along with the first and the third frame members.

The detailed features of the present invention will be apparent in the detailed description with appropriate reference to the accompanying drawings.

DETAILED DESCRIPTION OF PREFERRED EMBODIMENT

Figure 1:
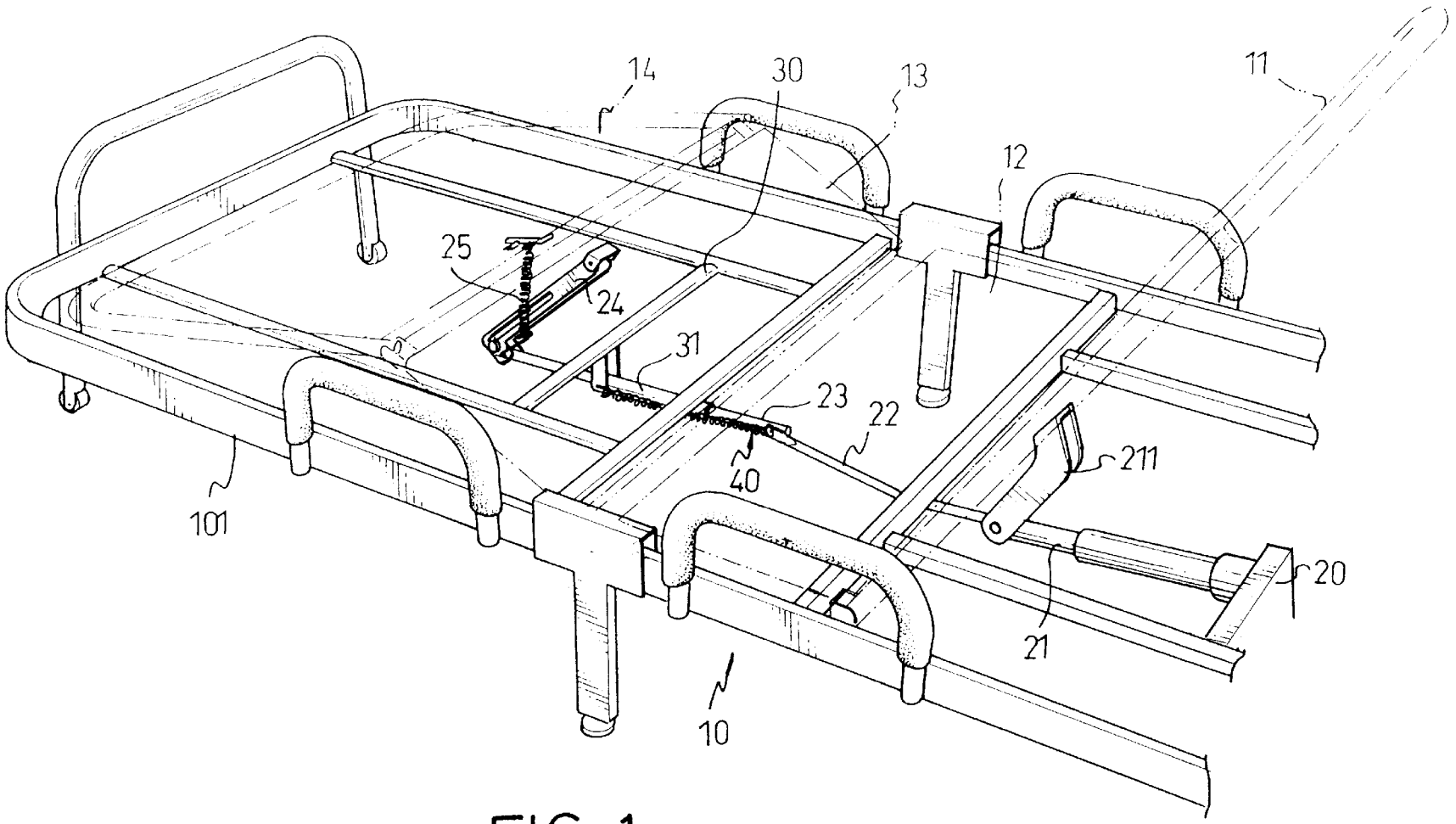
FIG. 1 is a perspective view showing the structure of the adjustable foldable bed constructed in accordance with the present invention.
Figure 2:
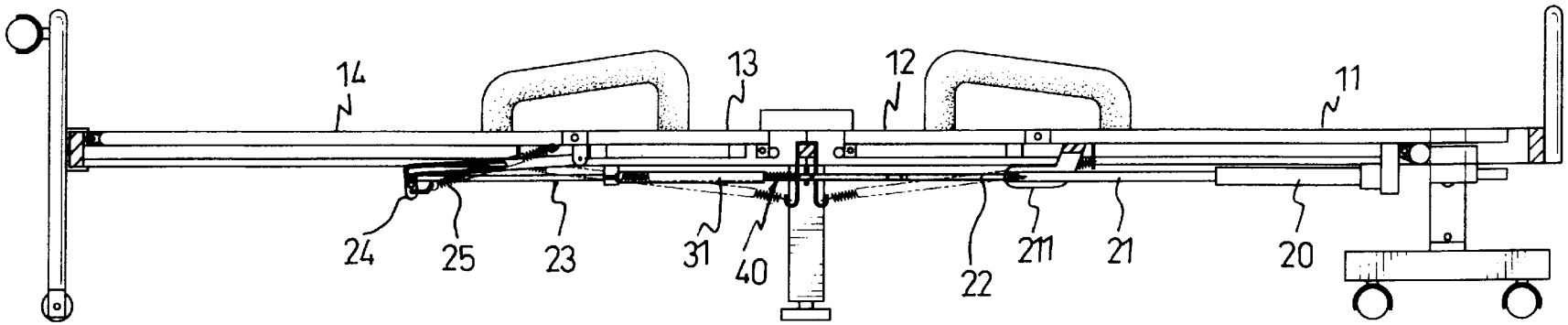
FIG. 2 is a side view of the foldable bed of FIG. 1.

The present invention relates to an adjustable foldable bed. Referring to FIGS. 1 and 2, the foldable bed has a front frame assembly (10) composed of a first frame member (11) and a second frame member (12) pivotally connected with the first frame member (11) and a rear frame assembly (101) composed of a third frame member (13) and a fourth frame member (14) pivotally connected with the third frame member (13). Furthermore, the foldable bed has a motor (20), a driving rod (21) extendably connected with the motor (20), a first connecting rod (22) pivotally connected with the driving rod (21), a second connecting rod (23) pivotally connected with the first connecting rod (22) and a tube (31) securely mounted under the second frame assembly (101) for receiving the second connecting rod (23) therethrough. The first frame member (11) has a first connector (211) securely connected thereunder and pivotally connected with the driving rod (21). The third frame member (13) has a second connector (24) pivotally connected thereunder and pivotally connected with the free end of the second connecting rod (23).

Figure 3:
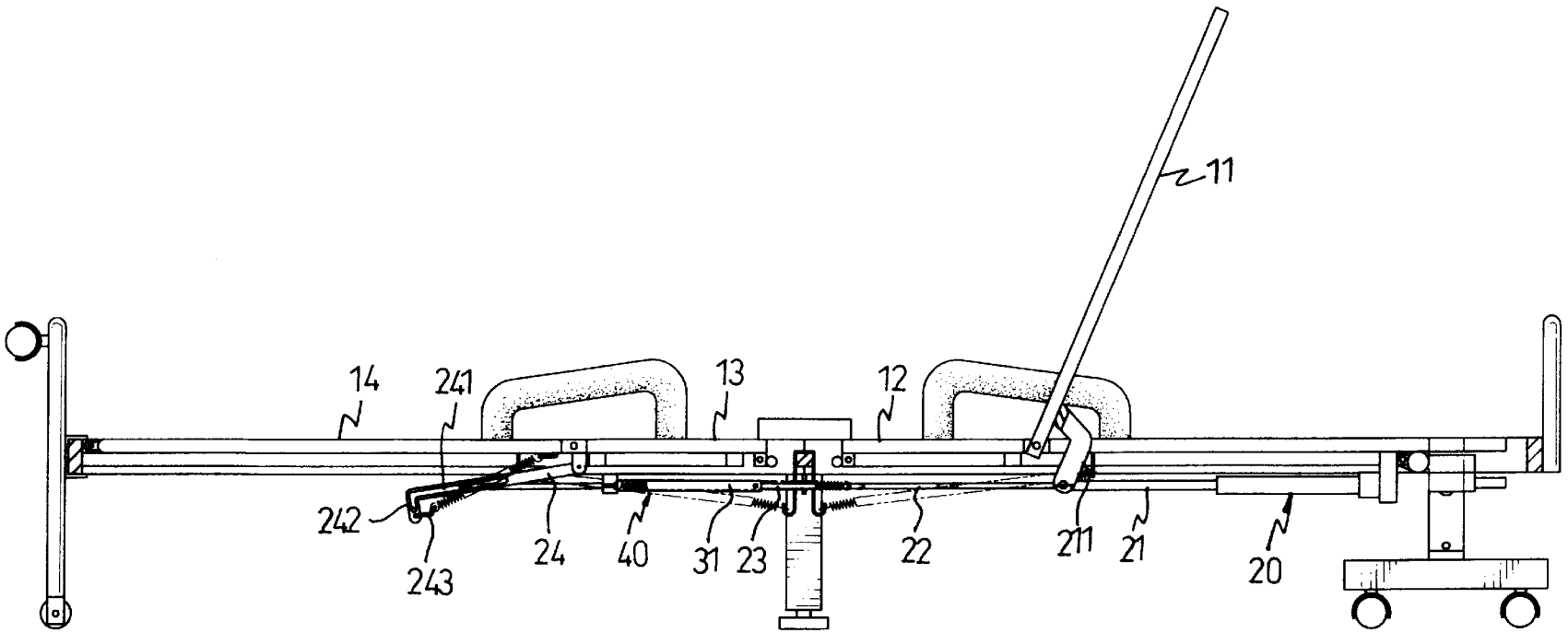
FIG. 3 is a side view showing the first frame member of FIG. 1 being lifted upward by a motor.

Shown in FIGS. 2 and 3 are the arrangement of the first connector (211) and the driving rod (21). One end of the first connector (211) is securely connected under the first frame member (11), and the other end thereof is pivotally connected with the driving rod (21), such that when the driving rod (21) extends or retracts following the activation of the motor (20), the first frame member (11) is able to incline upward or downward with respect to the second frame member (12).

Figure 4:
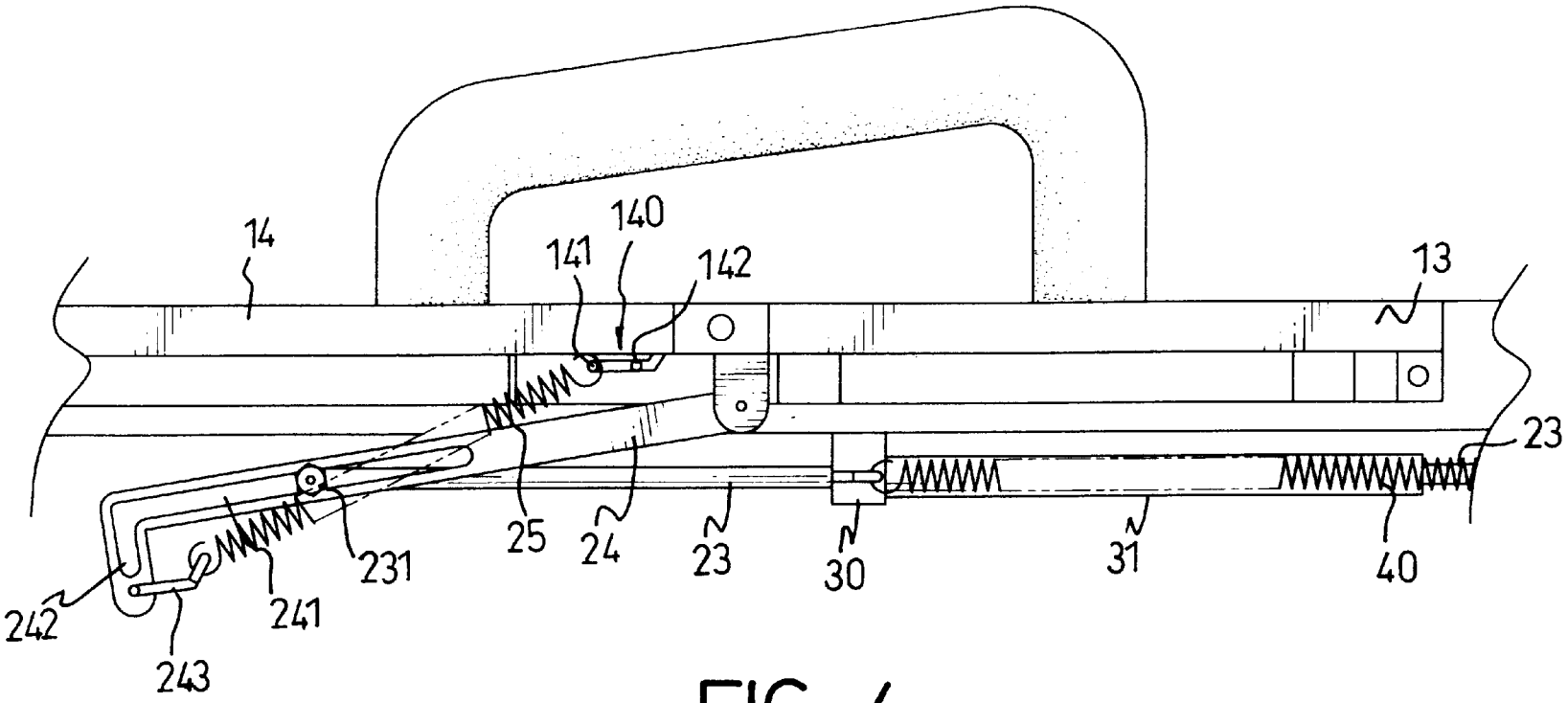
FIG. 4 is an enlarged side view showing the construction of the linkage under the fourth frame member in accordance with the present invention.
Figure 5:
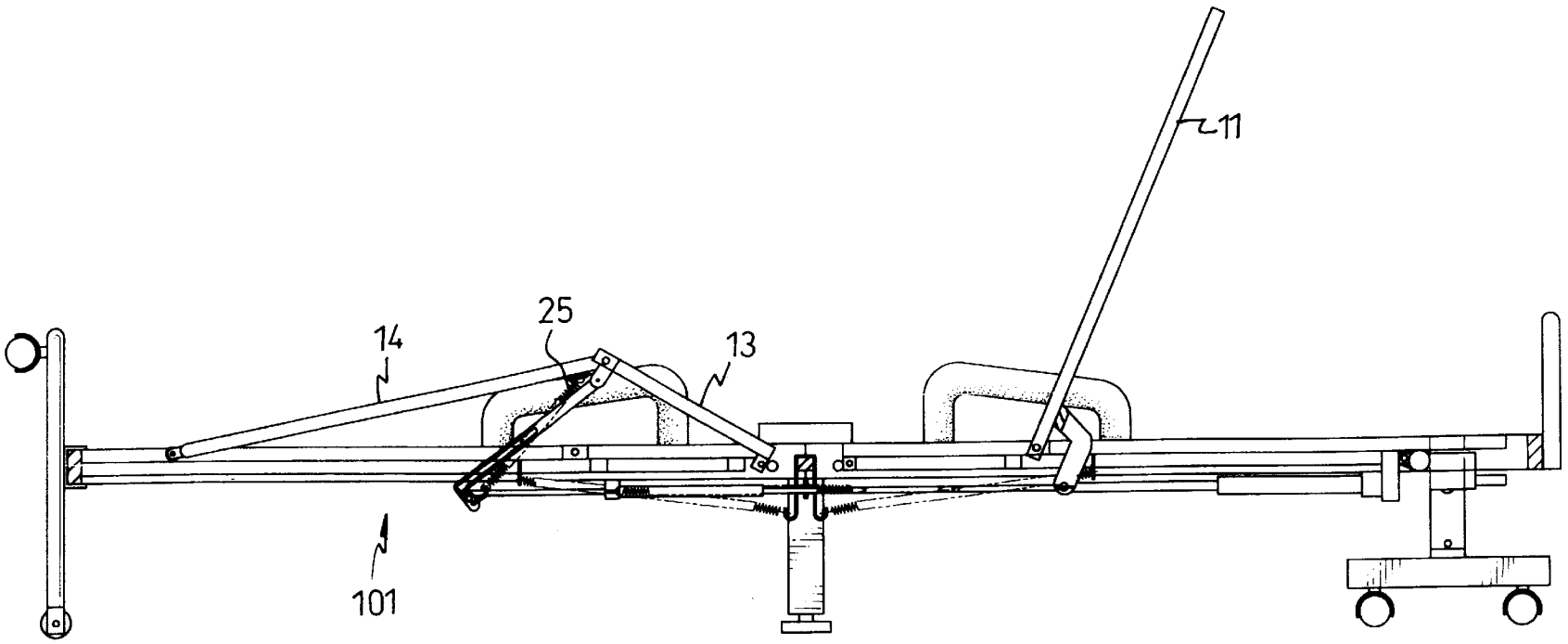
FIG. 5 is a side view showing the first and the third frame members of FIG. 1 being lifted simultaneously by the motor.
Figure 6:
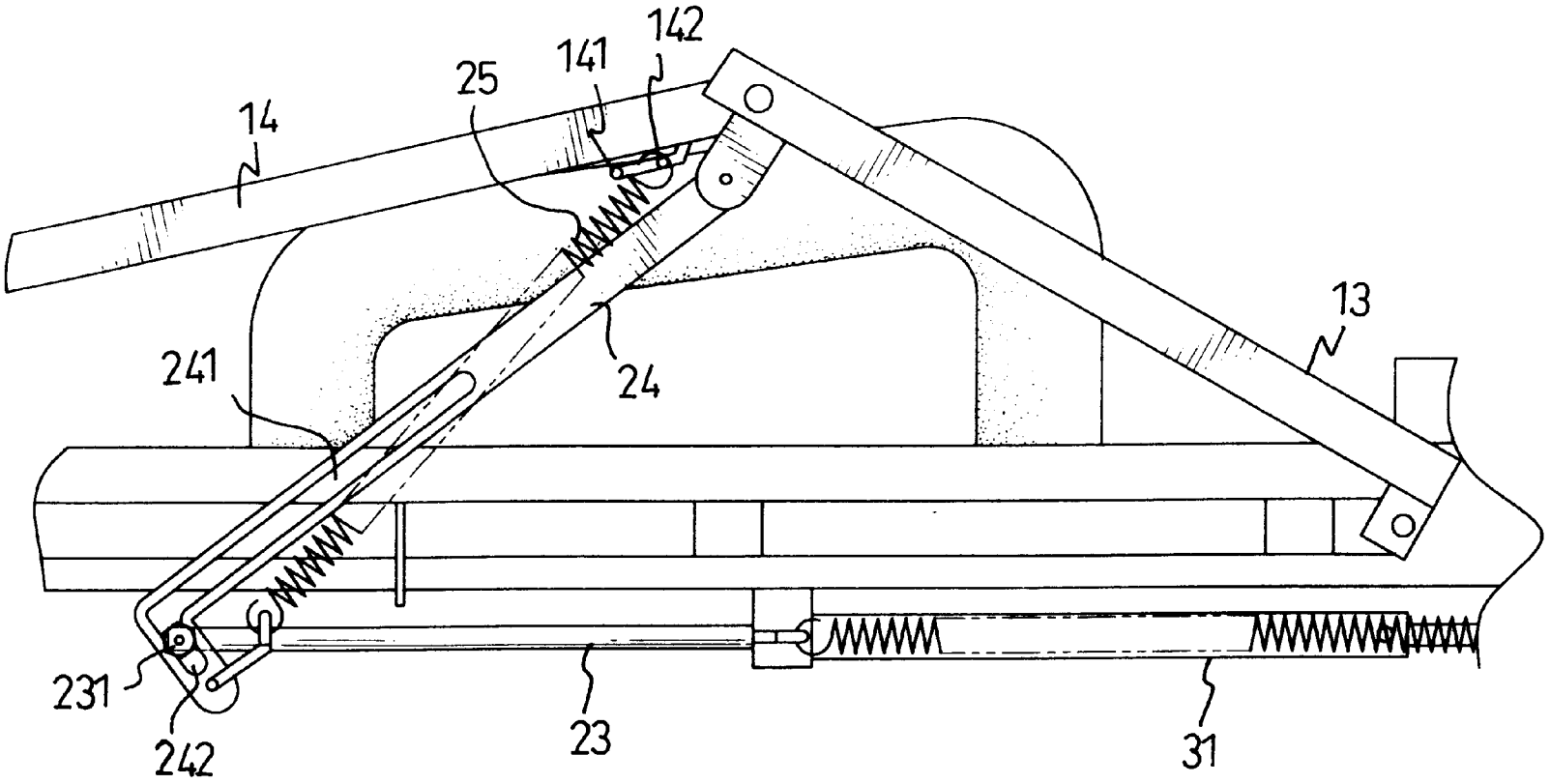
FIG. 6 is an enlarged side view showing the activation of the upward movement of the third frame member, wherein a second connecting rod is connected with the second connector at a second position in accordance with the present invention.

FIGS. 3 and 4 show that one end of the second connector (24) is attached securely under the third frame member (13) and the other end thereof is slidably and pivotally connected with the free end (231) of the second connecting rod (23). Preferably, the second connector (24) is composed of a pair of corresponding L-shaped plates with a first channel (241) defined in each one, and a second channel (242) communicating with and orthogonal to the first channel (241), wherein the first channel (241) is longer than the second channel (242). Furthermore, the second connector (24) has a first hook (243) formed beside the end of the second channel (242) and the fourth frame member (14) has a second hook (140) defined therein a first through hole (141) and a second through hole (142). The distal end of a first spring (25) is securely connected to the first hook (243) and the other distal end of the first spring (25) is selectively connected to either the first or the second through holes (141, 142). The second connector (24) is pivotally and slidably connected with the free end (231) of the second connecting rod (23). That is, the free end (231) of the second connecting rod (23) is slidably and pivotally received in the first and the second channels (241, 242). When the spring (25) is connected between the first hook (243) and the first through hole (141) of the second hook (140), the free end (231) of the second connecting rod (23) is movable with respect to the second connector (24). Under this arrangement, the free end (231) of the second connecting rod (23) will move away from the second channel (242) and the third frame member (13) will not be lifted upward by the activation of the motor (20). However, when the distal end of the first spring (25) is first released from connection with the first hook (243) and the free end (231) of the second connecting rod (23) is moved to the second channel (242) and the distal end of the first spring (25) is reconnected to the first hook (243), the free end (231) will thus remain in the second channel (242) because of the force of the first spring (25) applied to the end of the second connector (24). Therefore, when the motor (20) drives the driving rod (21) to retract, due to the free end (231) of the second connecting rod (23) fixed in the second channel (243), the second connector (24) will be driven to move and the third frame member (13) is accordingly inclined with respect to the second frame member (12), as shown in FIGS. 5 and 6.

Figure 7:
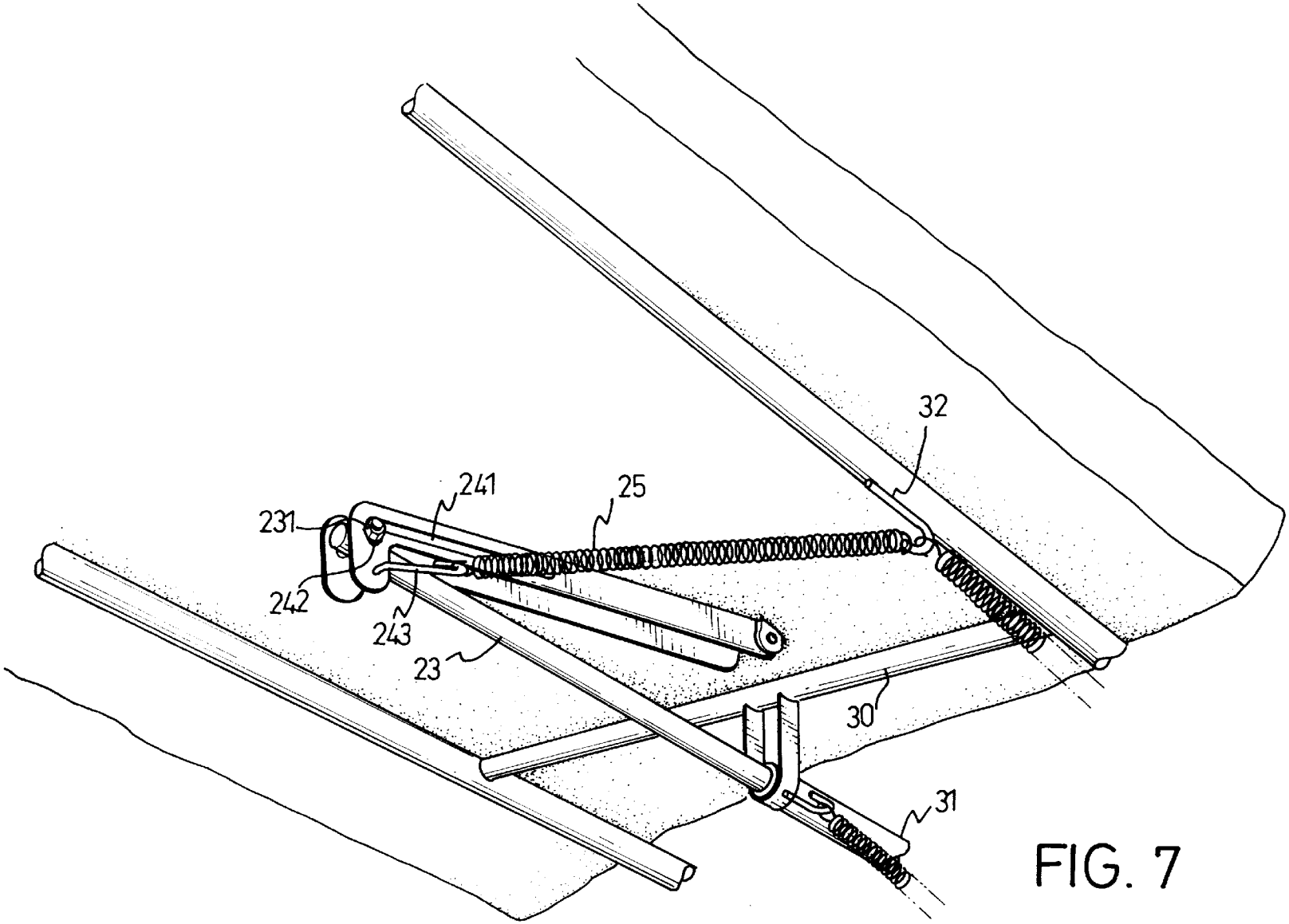
FIG. 7 is a bottom perspective view showing an alternative embodiment of the invention.
Figure 8:
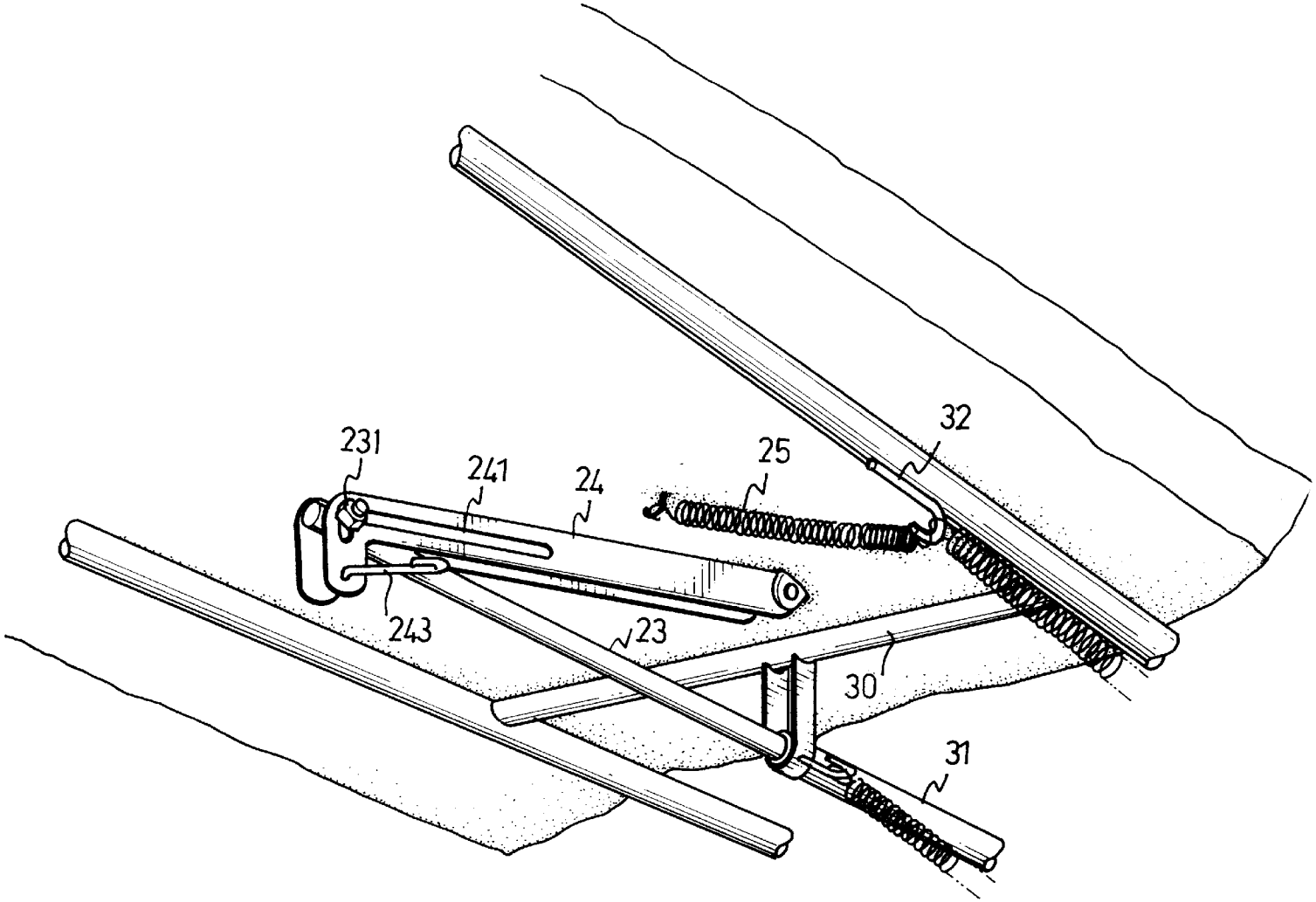
FIG. 8 is a bottom perspective view showing the disengagement of the spring with the second connector to disable the lift of the third frame member by the motor in accordance with the present invention.

FIGS. 7 and 8 show an alternative embodiment of the application of the first spring (25). One distal end of the first spring (25) is still connected with the first hook (243) and the other distal end thereof is disengagably connected with a third hook (32) securely mounted under the rear frame assembly (101), which allows the free end (231) of the second connecting rod (23) to move freely in the first and second channel (241,242) under the influence of the motor (20). Therefore, it is to be noted that when one end of the first spring (25) is securely connected to the first hooks (243), the free end (231) of the second connecting rod (23) can first be moved to the second channel (242). After the other end of the first spring (25) is securely connected to the third hook (32), the free end (231) of the second connecting rod (23) will be remained in the second channel (242) and the third frame member (13) will accordingly be lifted upward by the motor (20). When the distal end of the first spring (25) is disconnected with the first hook (243), the free end (231) of the second connecting rod (23) is free moving in the first channel (241), such that the third frame member (13) will not be lifted upward with respect to the second frame member (12), but only the first frame member (11) is lifted upward with respect to the second frame member (12).

Referring to FIGS. 1, 2 and 3, a second spring (40) is provided outside the tube (31) and between the joint of the first and the second connecting rods (22, 23) and a frame (30) which is securely provided under the bed. When the motor (20) lifts the first frame member (11), the second spring (40) will have a force stored therein. Therefore, the force stored in the second spring (40) will assist the first frame member (11) to return to its original position.

To sum up, the adjustable foldable bed has the following advantages:

1. Simple structure
2. Easy operation
3. Adjustable in folding sections

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable foldable bed comprising:

a first frame member (11); a second frame member (12) pivotally connected with the first frame member (11); a third frame member (13) pivotally connected with the second frame member (12); a fourth frame member (14) pivotally connected with the third frame member (13);

a motor (20) securely mounted under the bed;

a driving rod (21) extendably connected with the motor (20);

a first connecting rod (22) pivotally connected with a free end of the driving rod (21);

a second connecting rod (23) pivotally connected with a free end of the first connecting rod (22);

a tube (31) securely connected under the bed to receive the second connecting rod (23) therethrough;

a first connector (211) securely connected under the first frame member (11) and pivotally connected with the driving rod (21); and a second connector (24) pivotally connected under the third frame member (13) and having a first channel (241) and a second channel (242) defined therein to selectively receive the free end (231) of the second connecting rod (23);

wherein the first channel (241) communicates with and is orthogonal to the second channel (242);

whereby the first frame member (11) is selectively inclined with respect to the second frame member (12).

2. The adjustable foldable bed as claimed in claim 1, wherein the first channel (241) is longer than the second channel (242).

3. The adjustable foldable bed as claimed in claim 2, wherein a first hook (243) is formed beside the end of the second channel (242), a second hook (140) having a first through hole (141) and a second through hole (142) defined therein is formed under the fourth frame member (14) and a first spring (25) is connected between the first hook (243) and the second hook (140);

wherein a distal end of the first spring (25) is selectively connected with the first and the second through holes (141, 142), whereby the third frame member (13) is alternatively and selectively inclined with respect to the second frame member (12).

4. The adjustable foldable bed as claimed in claim 3, wherein a second spring (40) is securely connected with a bottom face of the bed and to an area where the second connecting rod (23) is pivotally connected to the first connecting rod (22).

* * * * *